US011832703B2

(12) United States Patent
Lee et al.

(10) Patent No.: US 11,832,703 B2
(45) Date of Patent: Dec. 5, 2023

(54) COSMETIC CONTAINER

(71) Applicant: SAMHWA CO., LTD, Uiwang-si (KR)

(72) Inventors: Kyungchang Lee, Uiwang-si (KR); Ki Sung Lee, Suwon-si (KR)

(73) Assignee: SAMHWA CO., LTD, Uiwang-si (KR)

( * ) Notice: Subject to any disclaimer, the term of this patent is extended or adjusted under 35 U.S.C. 154(b) by 292 days.

(21) Appl. No.: 17/369,893

(22) Filed: Jul. 7, 2021

(65) Prior Publication Data

US 2022/0095767 A1 Mar. 31, 2022

(30) Foreign Application Priority Data

Sep. 25, 2020 (KR) ..... 10-2020-0124330

(51) Int. Cl.

| | |
|---|---|
| ***A45D 33/16*** | (2006.01) |
| ***A45D 33/14*** | (2006.01) |
| ***A45D 33/00*** | (2006.01) |
| ***A45D 33/34*** | (2006.01) |

(52) U.S. Cl.

CPC ..... *A45D 33/16* (2013.01); *A45D 33/14* (2013.01); *A45D 33/34* (2013.01); *A45D 2033/001* (2013.01)

(58) Field of Classification Search

CPC ..... A45D 33/00; A45D 33/003; A45D 33/02; A45D 33/025; A45D 33/04; A45D 33/06; A45D 33/16; A45D 33/14; A45D 33/34; A45D 33/22; A45D 2033/001;

(Continued)

(56) References Cited

U.S. PATENT DOCUMENTS

2008/0251096 A1* 10/2008 Eng ..... A45D 33/025 132/294
2008/0276956 A1* 11/2008 Cho ..... A45D 33/04 132/294

(Continued)

FOREIGN PATENT DOCUMENTS

DE 19626195 A1 * 1/1998 ..... A45D 33/14
KR 10-1158910 B1 6/2012

(Continued)

OTHER PUBLICATIONS

DE19626195. Translation (Year: 1998).*

*Primary Examiner* — Cris L. Rodriguez
*Assistant Examiner* — Karim Asqiriba
(74) *Attorney, Agent, or Firm* — Park, Kim & Suh, LLC

(57) ABSTRACT

A cosmetic container that grinds and dispenses a content is disclosed. The cosmetic container includes: an inner container having an interior space filled with a content; a dial that is rotatably coupled at an upper part of the inner container and includes a dispensing hole for dispensing the content and a cutter for grinding the content; a screw that is positioned at a lower part of the dial within the interior space and rotates together with the dial; a piston inserted around the screw to ascend and descend within the interior space; and an elastic member that is positioned at a lower part of the piston and pushes the piston upward. The piston is screw-joined with the screw to maintain a particular height, and rotating the dial disengages the screw joint between the piston and the screw to allow the piston to be moved upward by the elastic member.

6 Claims, 10 Drawing Sheets

(58) Field of Classification Search
CPC ..... A45D 40/0068; A45D 40/0075; A45D 28/28; A45D 20/124
See application file for complete search history.

(56) References Cited

U.S. PATENT DOCUMENTS

| | | | | |
|---|---|---|---|---|
| 2011/0126851 | A1* | 6/2011 | Yeom | A45D 33/04 132/293 |
| 2018/0184783 | A1* | 7/2018 | Cheng | A45D 33/02 |
| 2018/0186551 | A1* | 7/2018 | Lee | A45D 33/025 |
| 2018/0295967 | A1* | 10/2018 | Byeon | B65D 47/00 |
| 2020/0148462 | A1* | 5/2020 | Brugger | B65D 83/64 |

FOREIGN PATENT DOCUMENTS

| | | | |
|---|---|---|---|
| KR | 10-1159135 | B1 | 7/2012 |
| KR | 10-2101103 | B1 | 4/2020 |

* cited by examiner

COSMETIC CONTAINER

CROSS-REFERENCE TO RELATED APPLICATIONS

This application claims the benefit of Korean Patent Application No. 10-2020-0124330, filed with the Korean Intellectual Property Office on Sep. 25, 2020, the disclosure of which is incorporated herein by reference in its entirety.

BACKGROUND

1. Technical Field

The present invention relates to a cosmetic container which grinds and dispenses a content within the container when a dial is rotated.

2. Description of the Related Art

While there is a wide variety in the types of cosmetics, classifying the types based on physical states would yield liquid types and solid types, as well as cream or gel types that correspond to intermediate forms. Solid type cosmetics can generally take the form of powders or sticks. A cosmetic content in the form of a powder may be produced and stored in a compressed state, and a user would use the content with an applicator such as a puff, etc. However, when compressed powder is applied on a puff, it may occur that the powder is not evenly applied or the particles are not in a uniform state.

To resolve this problem found in the conventional powder container, a cosmetic container is being used that is capable of grinding the powder. Such a grinding type cosmetic container can provide the advantage of evenly grinding the particles of the compressed powder, and an example of a grinding type cosmetic container may be found, among others, in Korean Registered Patent No. 1158910.

A conventional grinding type cosmetic container may have a structure in which rotating a dial causes a grinding of the content, as a piston screw-joined with the dial is moved upward. However, as the amount of upward movement of the piston exceeds the amount of content ground and dispensed, the content may be kept pressurized by the piston, so that the resulting stress may cause damage to the internal structures.

SUMMARY OF THE INVENTION

An aspect of the present invention, which was conceived to resolve the problem described above, is to provide a cosmetic container in which the piston can ascend in an amount that is in correspondence to the amount of dispensation of the content.

Also, an aspect of the invention is to provide a cosmetic container that allows easy refilling.

Other objectives of the present invention will be more clearly understood from the embodiments set forth below.

One aspect of the invention provides a cosmetic container that includes: an inner container, which may have an interior space configured to be filled with a content; a dial, which may be rotatably coupled at an upper part of the inner container and which may include a dispensing hole configured to dispense the content and a cutter configured to grind the content; a screw, which may be positioned at a lower part of the dial within the interior space and configured to rotate with the dial as an integrated body; a piston, which may be inserted around the screw to ascend and descend within the interior space; and an elastic member, which may be positioned at a lower part of the piston and configured to push the piston upward, where the piston may be coupled with the screw by way of a screw joint to maintain a particular height, and a rotating of the dial may cause a disengagement of the screw joint between the piston and the screw to allow the piston to be moved upward by the elastic member.

A container according to an embodiment of the present invention can include one or more of the following features. For example, an anti-rotation protrusion can be provided on an inner perimeter of the interior space, and an anti-rotation groove in which the anti-rotation protrusion may be inserted can be formed in a periphery of the piston.

A coupler protrusion can be formed on a lower part of the dial, and a coupler groove in which the coupler protrusion may be inserted can be formed in the screw.

The dial can include a dispensing surface member in which the dispensing hole may be formed, and an inner periphery member may be formed protruding upward from an edge of the dispensing surface member.

The cosmetic container can additionally include an outer container in which the inner container may be inserted, where a container coupler protrusion can be formed on the outer container, and a container coupler groove in which the container coupler protrusion may be inserted can be formed in the inner container.

The screw can include a lower spring groove, the piston can include an upper spring groove, and the elastic member can have both ends inserted in the lower spring groove and the upper spring groove, respectively.

The screw can include an outer thread, the piston can include an inner thread configured to mate with the outer thread, and the outer thread can be formed for one revolution.

An anti-rotation protrusion can be formed in the interior space, a guide protrusion can be formed on the piston, and an anti-rotation groove in which the anti-rotation protrusion may be movably inserted can be formed in an inner perimeter of the guide protrusion.

An embodiment of the present invention having the features above can provide various advantageous effects including the following. However, an embodiment of the present invention may not necessarily exhibit all of the effects below.

An embodiment of the present invention can provide a cosmetic container in which the content is not pressurized by the piston, as the piston may ascend in an amount that is in correspondence to the amount of dispensation of the content.

Also, an embodiment of the invention can provide a cosmetic container that is convenient to use and capable of grinding the content into even particle sizes.

DETAILED DESCRIPTION OF THE INVENTION

Figure 1:
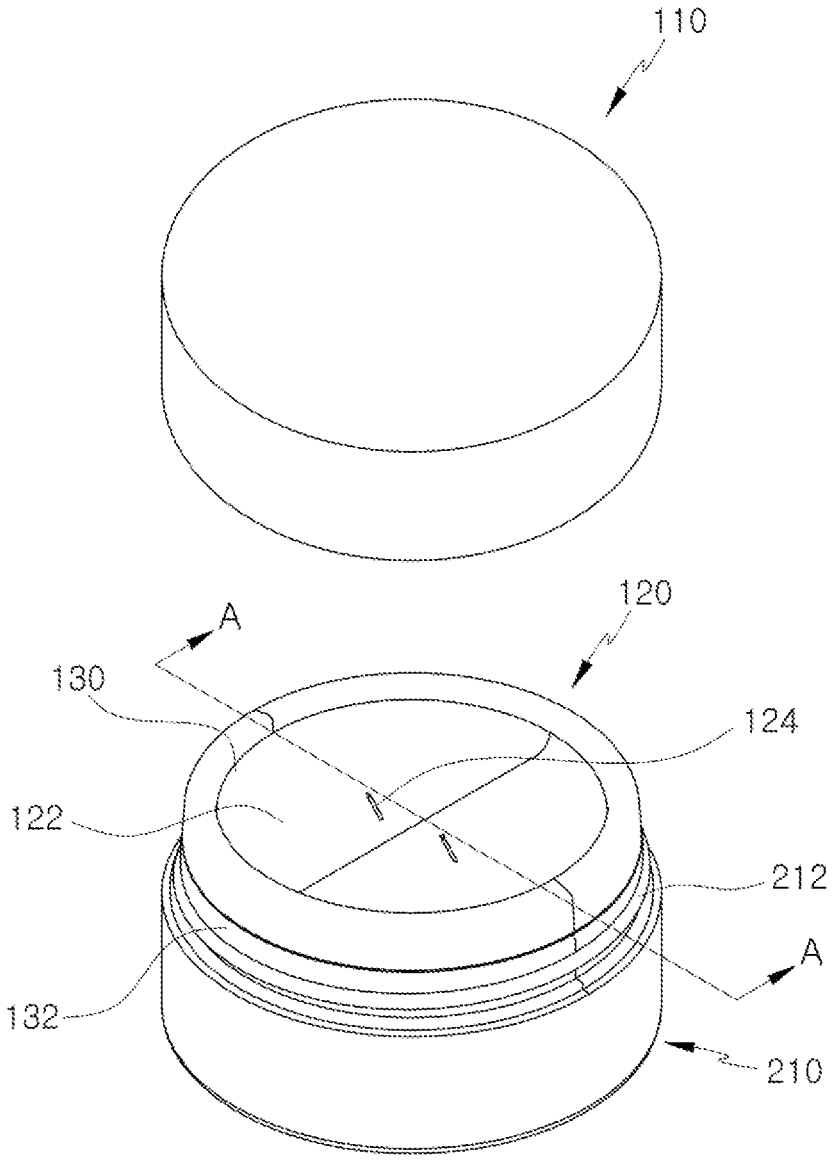
FIG. 1 is a perspective view of a cosmetic container according to a first disclosed embodiment of the invention.

As the invention allows for various changes and numerous embodiments, particular embodiments will be illustrated in the drawings and described in detail in the written description. However, this is not intended to limit the present invention to particular modes of practice, and it is to be appreciated that all changes, equivalents, and substitutes that do not depart from the spirit and technical scope of the present invention are encompassed by the present invention. In the description of the present invention, certain detailed explanations of the related art are omitted if it is deemed that they may unnecessarily obscure the essence of the invention.

The terms used in the present specification are merely used to describe particular embodiments and are not intended to limit the present invention. An expression used in the singular encompasses the expression of the plural, unless it has a clearly different meaning in the context. In the present specification, it is to be understood that terms such as "including" or "having," etc., are intended to indicate the existence of the features, numbers, steps, actions, components, parts, or combinations thereof disclosed in the specification and are not intended to preclude the possibility that one or more other features, numbers, steps, actions, components, parts, or combinations thereof may exist or may be added.

While such terms as "first" and "second," etc., can be used to describe various components, such components are not to be limited by the above terms. The above terms are used only to distinguish one component from another.

Certain embodiments of the present invention will be described below in more detail with reference to the accompanying drawings. Those components that are the same or are in correspondence are rendered the same reference numeral, and redundant descriptions are omitted.

The content stored in a cosmetic container based on an embodiment of the invention is not limited to cosmetics and can include substances of various properties for various purposes such as medicines, foods, etc.

Figure 2:
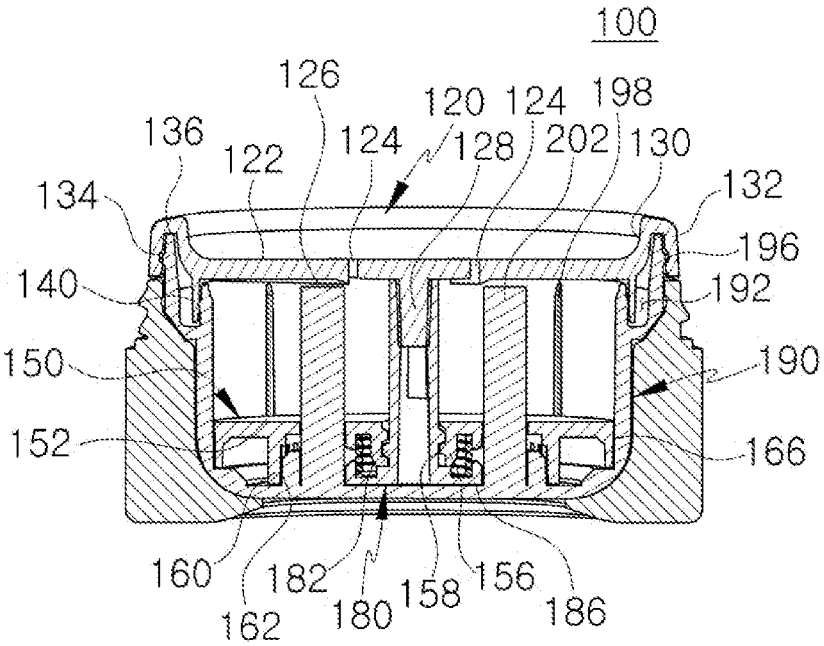
FIG. 2 is a cross-sectional view of the cosmetic container across line A-A of FIG. 1.

FIG. 1 is a perspective view of a cosmetic container 100 according to a first disclosed embodiment of the invention, and FIG. 2 is a cross-sectional view of the cosmetic container 100 across line A-A of FIG. 1.

Referring to FIG. 1 and FIG. 2, a cosmetic container 100 based on this embodiment may have a circular horizontal cross section, with its exterior formed by a cap 110 and an outer container 210. The cap 110 can be screw-joined with the outer container 210 to be separable, and when the cap 110 is removed, a dial 120 may be exposed to the outside. When the dial 120 is rotated, cutters 126 provided at a lower part of the dial 120 may rotate, thereby grinding the content. Here, the content can be pushed by an elastic member 230 and thus can be easily ground by the cutters 126 and easily dispensed to the outside through dispensing holes 124.

A cosmetic container 100 based on this embodiment may have a locking function that can keep the piston 150 at a particular height in order to supply the content. When the piston 150 is in a locked state as in FIG. 2, the piston 150 can remain at a particular height without ascending, in spite of the upward pushing force of the elastic member 230, making it easier to supply the content at the upper part of the piston 150. After the content is supplied, turning the dial 120 may disengage the locking function (see FIG. 12), and the piston 150 can be moved upward by the pushing force of the elastic member 230.

The cap 110 may be separably coupled to an upper part of the outer container 210 and may serve to close the dial 120. A cap thread lower hole 218 may be formed in the inner perimeter of the cap 110, where the cap thread lower hole 218 may be screw-joined with a coupler thread 214 provided on the upper part of the outer container 210.

Figure 3:
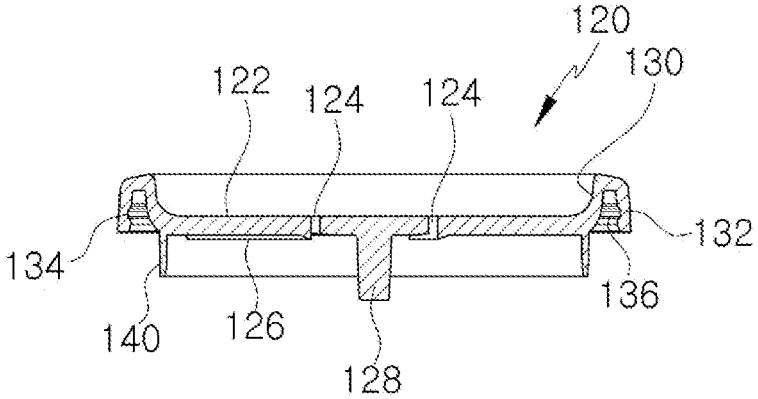
FIG. 3 is a cross-sectional view of the dial of the cosmetic container illustrated in FIG. 1.
Figure 4:
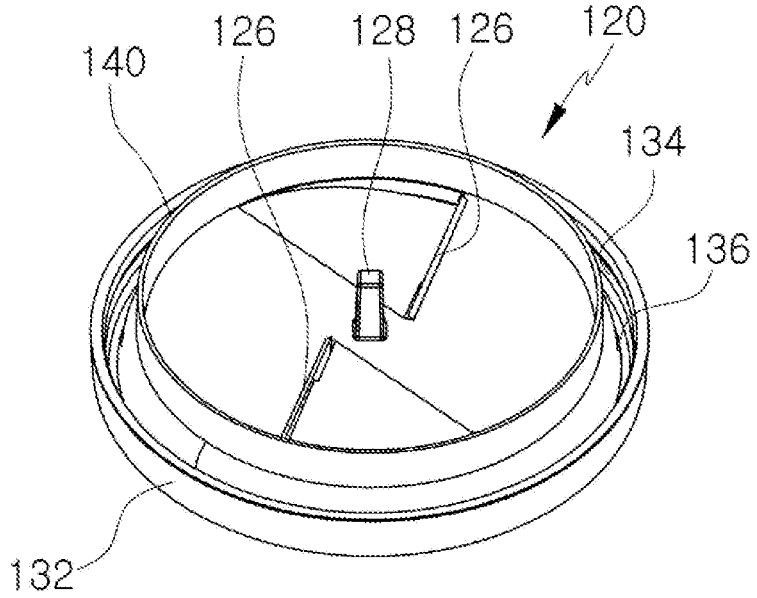
FIG. 4 is a perspective view illustrating a rear side of the dial.

FIG. 3 is a cross-sectional view of the dial 120 of the cosmetic container 100 illustrated in FIG. 1, and FIG. 4 is a perspective view illustrating the rear side of the dial 120.

Referring to FIGS. 2 to 4, when the cap 110 is separated from the outer container 210, the dial 120 may be exposed to the outside. The dial 120 may be rotatably coupled to an upper part of the inner container 190, and rotating the dial 120 may raise the piston 150 to a particular height and grind the content.

A circular dispensing surface member 122 may be formed at an upper part of the dial 120, and in the dispensing surface member 122, there may be formed a dispensing hole 124, corresponding to a passageway through which the ground content may be dispensed. The dispensing hole 124 can be formed in a linear shape, and two dispensing holes 124 for example can be formed with a particular gap in-between.

The two dispensing holes 124 can be positioned adjacent to each other. For example, the dispensing holes 124 can be formed symmetrically with respect to the center of rotation of the dispensing surface member 122.

At the edge of the dispensing surface member 122, there may be formed an inner periphery member 130 protruding upward. Thus, because of the inner periphery member 130, the upper part of the dial 120 can be made to have a concave shape, so that the dispensed content may not easily leak to the outside.

Below the dispensing surface member 122, cutters 126 may be provided for grinding the content. The cutters 126 may be positioned adjacent to the dispensing hole 124, whereby the ground content can be moved directly through the dispensing holes 124. The cutters 126 can be formed to have lengths greater than those of the dispensing holes 124.

A coupler protrusion 128 may be formed protruding from the center of the lower part of the dispensing surface member 122. The coupler protrusion 128 may have a particular length and may have a cross section shaped as a quadrilateral. The coupler protrusion 128 may be inserted into a coupler cavity 184 formed in an upper part of the screw 180, so that the rotation of the dial 120 may be transferred directly to the screw 180.

At the lower part of the dispensing surface member 122, there may be formed a lower periphery member 140. The lower periphery member 140 may be rotatably inserted into an inner groove 192 formed in the upper part of the inner container 190. The inner perimeter of the lower periphery member 140 may contact the inner perimeter of the inner groove 192, thereby preventing any leakage of the ground content to the outside.

On the outer side of the inner periphery member 130, there may be formed an outer periphery member 132. The outer periphery member 132 may be the part gripped by the user. The lower end of the outer periphery member 132 can be arranged to contact or almost contact the upper end of a container head 212 of the outer container 210.

A dial groove 136 may be formed between the inner periphery member 130 and the outer periphery member 132. A coupler periphery member 194 formed on an upper part of the inner container 190 may be rotatably inserted into the dial groove 136. Also, rotational protrusions 196 may be formed on the outer surface of the coupler periphery member 194, and a rotational groove 134 into which the rotational protrusions 196 may be inserted can be formed in the inner side of the dial groove 136. Such rotational protrusions 196 and rotational groove 134 may prevent the dial 120 from becoming easily detached from the inner container 190.

Figure 5:
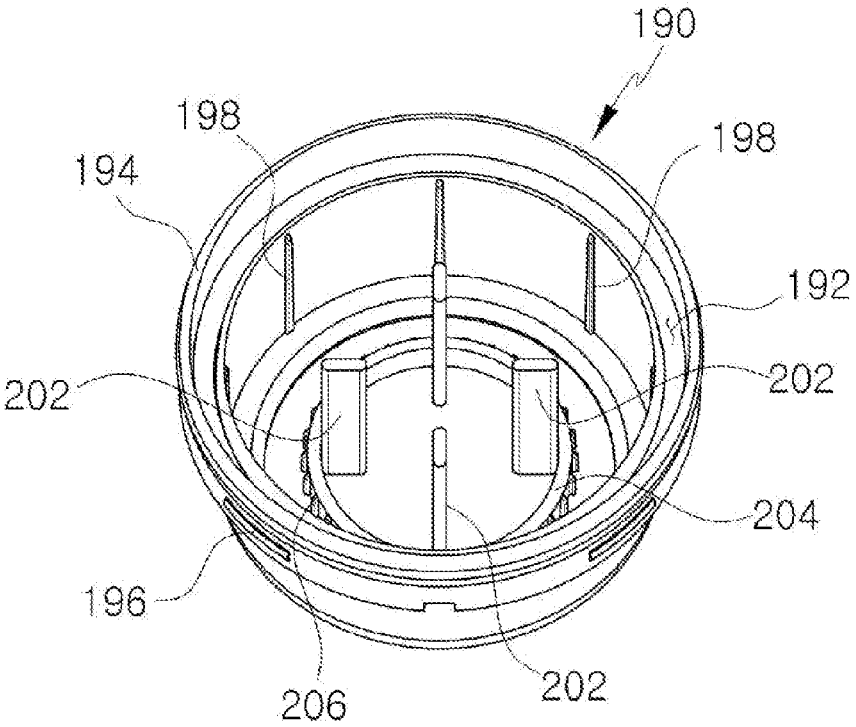
FIG. 5 is a perspective view illustrating the inner container.
Figure 6:
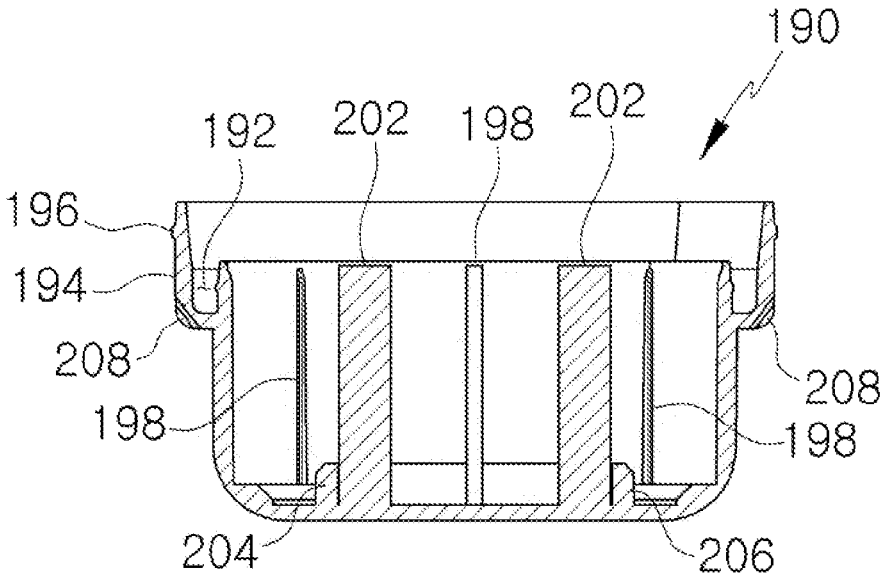
FIG. 6 is a cross-sectional view illustrating the inner container.

FIG. 5 and FIG. 6 are a perspective view and a cross-sectional view, respectively, illustrating the inner container 190.

Referring to FIG. 2, FIG. 5, and FIG. 6, the inner container 190 may be separably inserted within the outer container 210 and may store the content (not shown) therein. The top of the inner container 190 may be open, and the dial 120 may be rotatably coupled to the open top. Also, the piston 150, screw 180, and elastic member 230 may be positioned within the interior space of the inner container 190.

At an upper part of the inner container 190, there may be provided a coupler periphery member 194, which may have a larger diameter compared to other parts of the inner container 190. The rotational protrusions 196 may be provided on the outer perimeter of the coupler periphery member 194, where the rotational protrusions 196 may be rotatably inserted in the rotational groove 134 of the dial 120. Also, on the inside of the coupler periphery member 194, there may be formed an inner groove 192. The lower periphery member 140 of the dial 120 may be rotatably inserted in the inner groove 192.

On the inner perimeter within the interior space of the inner container 190, a multiple number of outer guide protrusions 198 may be formed in particular intervals. The outer guide protrusions 198 can be formed along the entire height within the interior space of the inner container 190. The outer guide protrusions 198 may be inserted in second anti-rotation grooves 168 formed in the outer perimeter of the piston 150 to thereby prevent the rotation of the piston 150.

At the center within the interior space of the inner container 190, there may be formed a body protrusion 204 having an annular shape, and there may be four inner guide protrusions 202 formed on the inside of the body protrusion 204. The inner guide protrusions 202 can also be formed within the interior space of the inner container 190 in heights that reach a particular distance from the lower surface of the dial 120. The inner guide protrusions 202 may be movably inserted through guide holes 154 formed in the piston 150. The inner guide protrusions 202 may be inserted into the content (not shown) to prevent the content from rotating and, as a result, allowing the cutters 126 to grind the content more efficiently.

Thus, the outer guide protrusions 198 and the inner guide protrusions 202 formed in the interior space of the inner container 190 can prevent the piston 150 and the content from rotating and can enable stable ascent and descent.

The annularly shaped body protrusion 204 may be formed on the bottom surface of the inner container 190. The body protrusion 204 may have a smaller height compared to the inner container 190 and may have a multiple number of anti-rotation protrusions 206 formed along its periphery in particular intervals. The anti-rotation protrusions 206 may be movably inserted in first anti-rotation grooves 162 formed in the inner perimeter of a guide protrusion 160 of the piston 150, thereby preventing the piston 150 from rotating but allowing upward and downward movement.

Container coupler grooves 208 can be formed in a lower part of the coupler periphery member 194. Container coupler protrusions 220 formed on the outer container 210 can be inserted into the container coupler grooves 208, whereby the inner container 190 can be coupled within the outer container 210 in a stable manner. Of course, when the inner container 190 is separated from the outer container 210 to supply the content, the container coupler protrusions 220 can be separated from the container coupler grooves 208.

Figure 7:
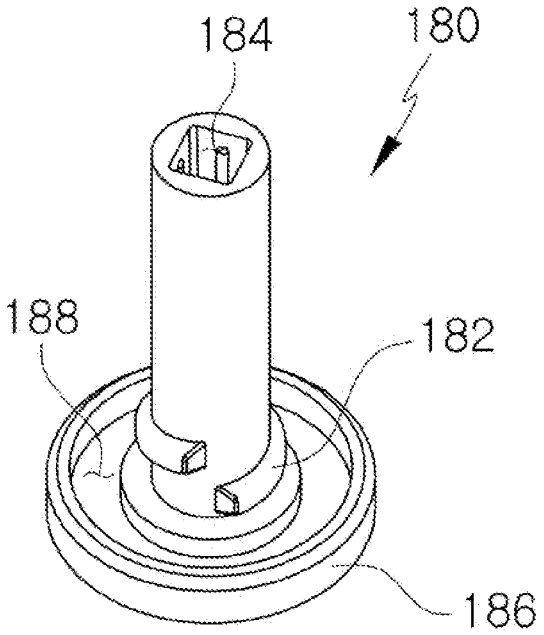
FIG. 7 is a perspective view illustrating the screw.

FIG. 7 is a perspective view illustrating the screw 180.

Referring to FIG. 2 and FIG. 7, the screw 180 may be provided under the dial 120 within the inner container 190. The screw 180 may rotate as an integrated body with the dial 120 and may serve to raise the piston 150, which may be screw-joined to a periphery thereof, up to a particular height or lower the piston 150 to a lowest point.

The screw 180 may have the shape of a hollow cylinder and may have a coupler cavity 184 formed in the upper part. The coupler protrusion 128 of the dial 120 may be coupled to the coupler cavity 184, whereby the dial 120 and the screw 180 may be made to rotate together as an integrated body.

An outer thread 182 may be formed on the outer perimeter of the screw 180. The outer thread 182 may be screw-joined to an inner thread 158 formed in the center of the piston 150. As a result, the rotational motion of the screw 180 can be transferred to the piston 150, allowing the piston 150 to undergo an ascending or descending motion.

The outer thread 182 can be formed to a particular length only at the lower part of the screw 180 rather than along the entire lengthwise direction of the screw 180. Thus, the raising of the piston 150 by the rotation of the screw 180 may occur only along the portion where the outer thread 182 is formed, and when the piston 150 reaches a height where there is no outer thread 182 formed, then the piston 150 may be raised by the upward pushing force of the elastic member 230. When the piston 150 reaches the point where the outer thread 182 is no longer present, the locking function of the elastic member 230 may be disengaged, enabling the upward raising by the elastic member 230.

A circular base 186 may be formed at a lower part of the screw 180, where the base 186 may enable the screw 180 to rotate in a stable manner. The base 186 may be rotatably positioned on the bottom surface of the inner container 190. A concavely formed lower spring groove 188 may be formed in the base 186, and the lower end of the elastic member 230 may be positioned therein.

Figure 8:
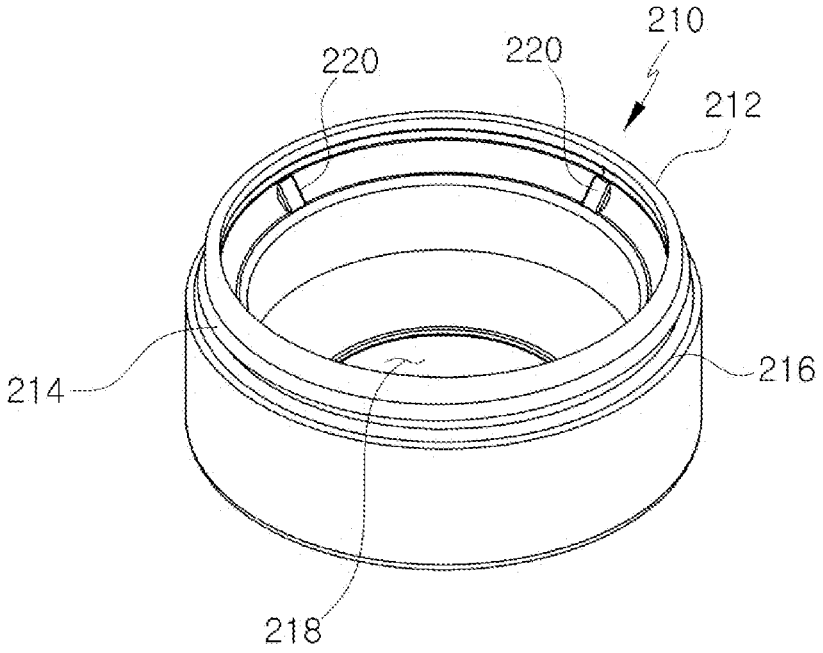
FIG. 8 is a perspective view illustrating the outer container.

FIG. 8 is a perspective view illustrating the outer container 210.

Referring to FIG. 2 and FIG. 8, the outer container 210 may form the exterior of the cosmetic container 100 and may house the inner container 190 within. The cap 110 may be screw-joined onto the open top of the outer container 210. The outer container 210 may be structured to have both its upper end and lower end open and have a container head 212 formed on an upper part thereof. A coupler thread 214 may be formed around the periphery of the container head 212, and the coupler thread 214 may be screw-joined with the cap thread lower hole 218 formed in the cap 110.

A step 216 may be formed at an upper part of the outer perimeter of the outer container 210, and the lower end of the cap 110 can be positioned on the step 216. A lower hole 218 may be formed in a lower part of the outer container 210, and a lower surface of the inner container 190 can be exposed to the outside through the lower hole 218.

A multiple number of container coupler protrusions 220 may be formed in particular intervals on an upper part of the inner perimeter of the outer container 210. The container coupler protrusions 220 may be inserted into the container coupler grooves 208 formed in the inner container 190, whereby the inner container 190 may be separably coupled onto the outer container 210.

The outer container 210 forming the exterior of the cosmetic container 100 can be fabricated from a material different from that of the other components such as a glass material, for example.

Figure 9:
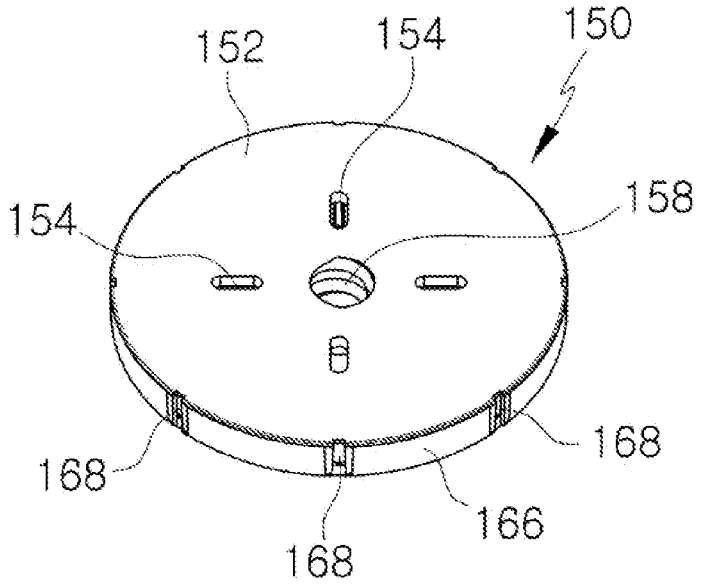
FIG. 9 and FIG. 10 are perspective views respectively illustrating the upper side and lower side of the piston.
Figure 10:
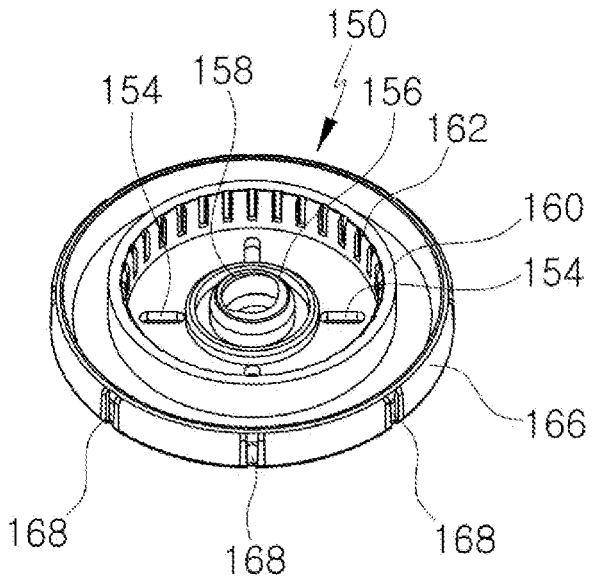
Figure 11:
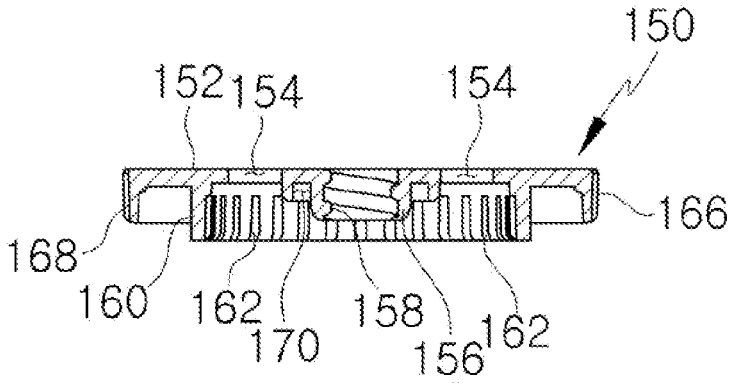
FIG. 11 is a cross-sectional view of the piston.

FIGS. 9 to 11 are perspective views and a central cross-sectional view, respectively, illustrating the piston 150.

Referring to FIGS. 9 to 11, the piston 150 may include a circular elevated surface member 152. The content may be positioned on the upper part of the elevated surface member 152. Also, a multiple number of guide holes 154 may be formed in the elevated surface member 152. The inner guide protrusions 202 may be movably inserted through the guide holes 154 to prevent the content from rotating and allow a stable manner of ascending and descending.

At the center of the piston 150, there may be a center protrusion 156 protruding downwards. The center protrusion 156 may have the shape of a hollow cylinder with both ends open. In the inner perimeter of the center protrusion 156, there may be formed an inner thread 158. The inner thread 158 may be screw-joined with the outer thread 182 formed on the outer perimeter of the screw 180, whereby the rotation of the screw 180 may be transferred to the piston 150.

The guide protrusion 160 may be formed around the center protrusion 156 on a lower part of the piston 150. The guide protrusion 160 may have the shape of a hollow cylinder with the bottom end open, and the guide protrusion 160 may be formed with a diameter larger than that of the center protrusion 156.

In the inner perimeter of the guide protrusion 160, a multiple number of first anti-rotation grooves 162 may be formed in particular intervals. The anti-rotation protrusions 206 formed on the inner container 190 may be inserted in the first anti-rotation grooves 162, thereby preventing the rotation of the piston 150 and allowing smooth ascending and descending movement.

At a periphery of the piston 150, there may be formed a contact surface member 166. The contact surface member 166 may protrude downward from the edge of the elevated surface member 152 to contact the inner perimeter of the inner container 190. This can prevent the ground content from leaking below the piston 150.

The multiple second anti-rotation grooves 168 may be formed in the contact surface member 166. The second anti-rotation grooves 168 can have the same structure as that of the first anti-rotation grooves 162. The outer guide protrusions 198 formed on the inner container 190 may be inserted in the second anti-rotation grooves 168, thereby preventing the rotation of the piston 150 and allowing smooth ascending and descending movement.

Around the periphery of the center protrusion 156, there may be formed an upper spring groove 170 having an annular shape. The upper end of the elastic member 230 may be inserted in the upper spring groove 170, so that the elastic member 230 can be prevented from becoming detached.

As the elastic member 230 has both ends positioned in the lower spring groove 188 formed in the screw 180 and the upper spring groove 170 formed in the piston 150, respectively, the elastic member 230 may serve to push the piston 150 upward. In particular, when the piston 150 passes beyond the section where the outer thread 182 of the screw 180 is formed, so that the piston 150 is disengaged from the locked state and is not raised by the rotation of the screw 180, the elastic member 230 may push and move the piston 150 upward. As the elastic member 230 thus pushes the piston 150 upward, the content can be easily ground by the cutters 126, and the piston 150 may ascend in proportion to the volume of the content that has been decreased by the grinding without applying pressure on the content.

The diameter of the elastic member 230 can be varied as needed. Thus, in a cosmetic container based on another embodiment of the invention, the elastic member can be positioned on the outside of the guide protrusion 160 of the piston 150.

Figure 12:
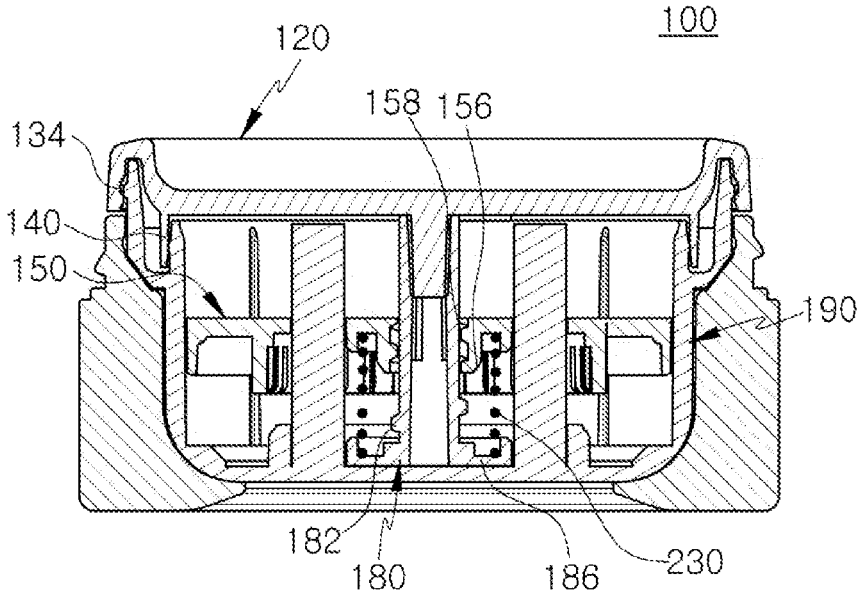
FIG. 12 is a cross-sectional view in which the piston that has been raised by a rotation of the dial.

FIG. 12 is a cross-sectional view in which the piston 150 has been raised by a rotation of the dial 120 such that the locked state has been disengaged.

Referring to FIG. 2, while the inner thread 158 of the piston 150 is coupled to the outer thread 182 of the screw 180, the piston 150 may be in a locked state and thus may not be raised by the elastic member 230. Here, when the dial 120 is rotated, the piston 150 may ascend and descend by a particular height due to the coupling between the inner thread 158 and outer thread 182. In particular, it is possible to rotate the dial 120 such that the piston 150 is positioned at its lowest point, as illustrated in FIG. 2.

When the piston 150 is positioned at the lowest point, the piston 150 is in a locked state and is unable to move upward, making it easy to supply the content. If the piston 150 were not in a locked state, the elastic force of the elastic member 230 would make it very difficult to maintain the piston 150 at a particular.

Referring to FIG. 12, after supplying the content, rotating the dial 120 may move the piston 150 upward until the coupling of the inner thread 158 and the outer thread 182 is disengaged. As a result, the piston 150 may be released from the locked state and can be moved upward by the elastic member 230.

Of course, to resupply the content, the piston 150 may be pressed down, and the dial 120 may be rotated such that the inner thread 158 and the outer thread 182 engage each other, whereby the height of the piston 150 can be fixed.

While the foregoing provides a description with reference to an embodiment of the present invention, it should be appreciated that a person having ordinary skill in the relevant field of art would be able to make various modifications and alterations to the present invention without departing from the spirit and scope of the present invention set forth in the scope of claims below.

What is claimed is:

1. A cosmetic container comprising:

an inner container having an interior space, the interior space being configured to be filled with a content;

a dial rotatably coupled at an upper part of the inner container, the dial comprising a dispensing hole and a cutter, the dispensing hole being configured to dispense the content, the cutter being configured to grind the content;

a screw positioned at a lower part of the dial within the interior space and configured to rotate with the dial as an integrated body;

a piston inserted around the screw to ascend and descend within the interior space; and an elastic member positioned at a lower part of the piston and configured to push the piston upward, wherein the piston is coupled with the screw by way of a screw joint to maintain a height, and a rotating of the dial causes a disengagement of the screw joint between the piston and the screw to allow the piston to be moved upward by the elastic member, wherein the inner container comprises:

a cylindrical body having an opened top end and a closed bottom end;

an annular body protrusion extended upward from a bottom surface of the cylindrical body;

anti-rotation protrusions formed on an outer surface of the annular body protrusion;

outer guide protrusions formed on an inner side surface of the cylindrical body; and a coupler peripheral member formed at an upper part of the cylindrical body to form an inner groove, a diameter of the coupler peripheral member being greater than a diameter of the cylindrical body, wherein the piston comprises:

an elevated surface member on which the content is positioned;

a guide protrusion extended downward from a bottom surface of the surface member, the guide protrusion having a hollow cylinder shape having an opened bottom end;

first anti-rotation grooves provided on an inner surface of the guide protrusion, wherein the anti-rotation protrusions of the inner container are inserted into the first anti-rotation grooves in order to prevent a rotation of the piston;

a contact surface member formed on an edge of the elevated surface member, the contact surface member having a hollow cylinder shape having an opened bottom end; and second anti-rotation grooves provided on an outer surface of the contact surface member, wherein the outer guide protrusions of the inner container are inserted into the second anti-rotation grooves in order to prevent the rotation of the piston, wherein the dial comprises:

a dispensing surface member having the dispensing hole and the cutter; and a lower peripheral member extended downward from a bottom surface of the dispensing surface member, wherein the lower peripheral member is rotatably inserted into the inner groove of the inner container.

2. The cosmetic container of claim 1, wherein the dial has a coupler protrusion formed on a lower part thereof, and the screw has a coupler cavity formed therein, the coupler cavity being configured to receive the coupler protrusion inserted therein.

3. The cosmetic container of claim 1, wherein the dial comprises a dispensing surface member having the dispensing hole formed therein, and an inner periphery member is formed protruding upward from an edge of the dispensing surface member.

4. The cosmetic container of claim 1, further comprising:

an outer container having the inner container inserted therein, wherein the outer container has a container coupler protrusion formed thereon, and the inner container has a container coupler groove formed therein, the container coupler groove being configured to receive the container coupler protrusion inserted therein.

5. The cosmetic container of claim 1, wherein the screw comprises a lower spring groove, the piston comprises an upper spring groove, and the elastic member has both ends thereof inserted in the lower spring groove and the upper spring groove, respectively.

6. The cosmetic container of claim 1, wherein the screw comprises an outer thread, the piston comprises an inner thread configured to mate with the outer thread, and the outer thread is formed for one revolution.

* * * * *